US006546969B1

(12) United States Patent
Kelley, II

(10) Patent No.: US 6,546,969 B1
(45) Date of Patent: Apr. 15, 2003

(54) SUGAR DISPENSING APPARATUS

(76) Inventor: Raymond C. Kelley, II, 112 N. Clinton Ave., North Patch Gue, NY (US) 11772

( * ) Notice: Subject to any disclaimer, the term of this patent is extended or adjusted under 35 U.S.C. 154(b) by 0 days.

(21) Appl. No.: 10/076,243

(22) Filed: Feb. 15, 2002

(51) Int. Cl.[7] ..... B65B 1/04
(52) U.S. Cl. ..... 141/18; 141/330; 222/81; 222/88
(58) Field of Search ..... 141/18, 329, 330; 222/81, 88, 185.1, 181.1, 182

(56) References Cited

U.S. PATENT DOCUMENTS 4,562,940 A * 1/1986 Asphar ..... 222/88
5,642,762 A * 7/1997 Greenberg et al. ..... 141/358
5,960,238 A * 9/1999 Ohgami ..... 399/258

* cited by examiner

*Primary Examiner*—Steven O. Douglas

(57) ABSTRACT

A sugar dispensing apparatus for conveniently storing and dispensing sugar to selected beverage containers. The sugar dispensing apparatus includes a housing assembly including a housing having front, back, side, bottom, and top walls, and an opening in said top wall, and also including a lid being removably disposed over the opening in the top wall of the housing; and also includes a hopper assembly including a hopper being securely disposed in the housing and having at least one sugar dispensing port; and further includes a shelf being securely mounted upon the hopper in the housing and having a plurality of holes being spaced about and being disposed therethrough and being adapted to allow sugar to enter said hopper; and also includes a bag-breaking member being securely disposed upon the shelf for breaking a bag containing sugar; and further includes an assembly for dispensing sugar from the hopper through at least one sugar dispensing port.

18 Claims, 5 Drawing Sheets

SUGAR DISPENSING APPARATUS

BACKGROUND OF THE INVENTION

1. Field of the Invention

The present invention relates to sugar dispensers for beverage containers and more particularly pertains to a new sugar dispensing apparatus for conveniently storing and dispensing sugar to selected beverage containers.

2. Description of the Prior Art

The use of sugar dispensers for beverage containers is known in the prior art. More specifically, sugar dispensers for beverage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,145,705; U.S. Pat. No. 5,437,396; U.S. Pat. No. 3,650,439; U.S. Pat. No. 4,266,695; U.S. Pat. No. Des. 336,015; and U.S. Pat. No. 3,659,745.

While these devices fulfill their respective, particular objectives and requirements, the aforementioned patents do not disclose a new sugar dispensing apparatus. The prior art describes inventions housing for dispensing coffee therefrom.

SUMMARY OF THE INVENTION

The general purpose of the present invention, which will be described subsequently in greater detail, is to provide a new sugar dispensing apparatus which has many of the advantages of the sugar dispensers for beverage containers mentioned heretofore and many novel features that result in a new sugar dispensing apparatus which is not anticipated, rendered obvious, suggested, or even implied by any of the prior art sugar dispensers for beverage containers, either alone or in any combination thereof. The inventive device includes a housing assembly including a housing having front, back, side, bottom, and top walls, and an opening in said top wall, and also including a lid being removably disposed over the opening in the top wall of the housing; and also includes a hopper assembly including a hopper being securely disposed in the housing and having at least one sugar dispensing port; and further includes a shelf being securely mounted upon the hopper in the housing and having a plurality of holes being spaced about and being disposed therethrough and being adapted to allow sugar to enter said hopper; and also includes a bag-breaking member being securely disposed upon the shelf for breaking a bag containing sugar; and further includes an assembly for dispensing sugar from the hopper through at least one sugar dispensing port.

There has thus been outlined, rather broadly, the more important features of the sugar dispensing apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new sugar dispensing apparatus which has many of the advantages of the sugar dispensers for beverage containers mentioned heretofore and many novel features that result in a new sugar dispensing apparatus which is not anticipated, rendered obvious, suggested, or even implied by any of the prior art sugar dispensers for beverage containers, either alone or in any combination thereof.

Still another object of the present invention is to provide a new sugar dispensing apparatus for conveniently storing and dispensing sugar to selected beverage containers.

Still yet another object of the present invention is to provide a new sugar dispensing apparatus that is easy and convenient to use.

Even still another object of the present invention is to provide a new sugar dispensing apparatus that is efficient and keeps the area clean and also prevents undo waste through spillage and overuse.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
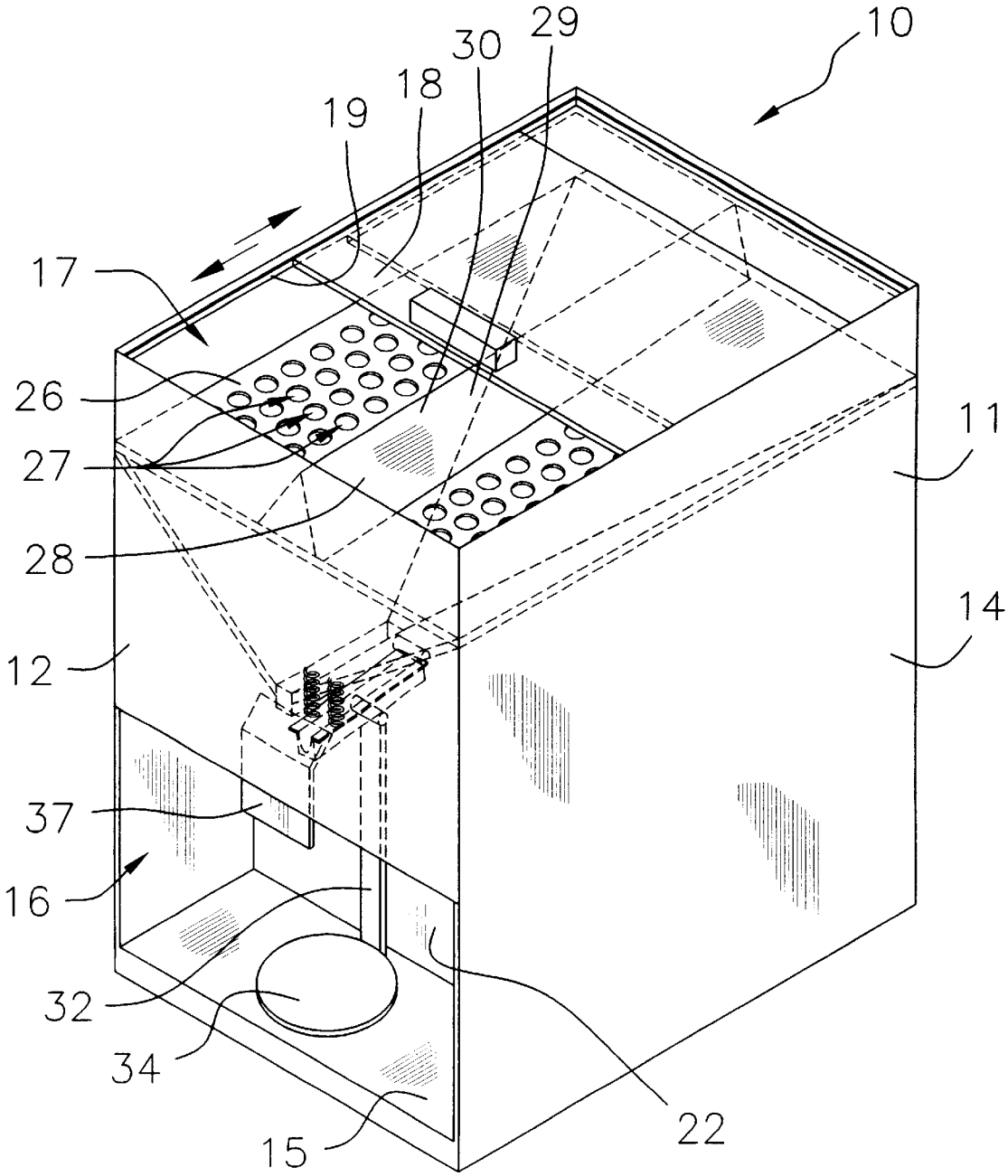
FIG. 1 is a perspective view of a new sugar dispensing apparatus according to the present invention.
Figure 2:
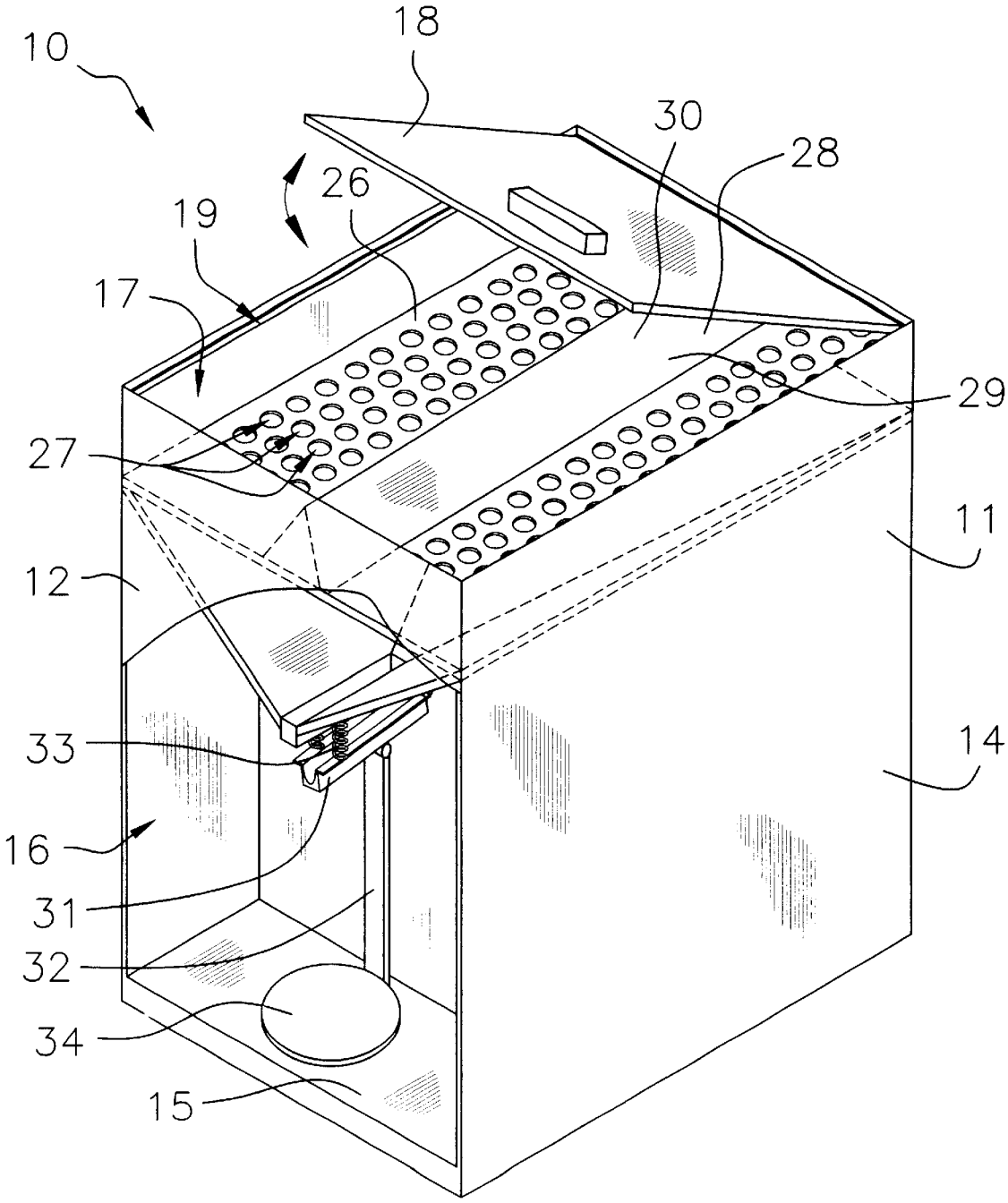
FIG. 2 is another perspective view of the present invention.
Figure 3:
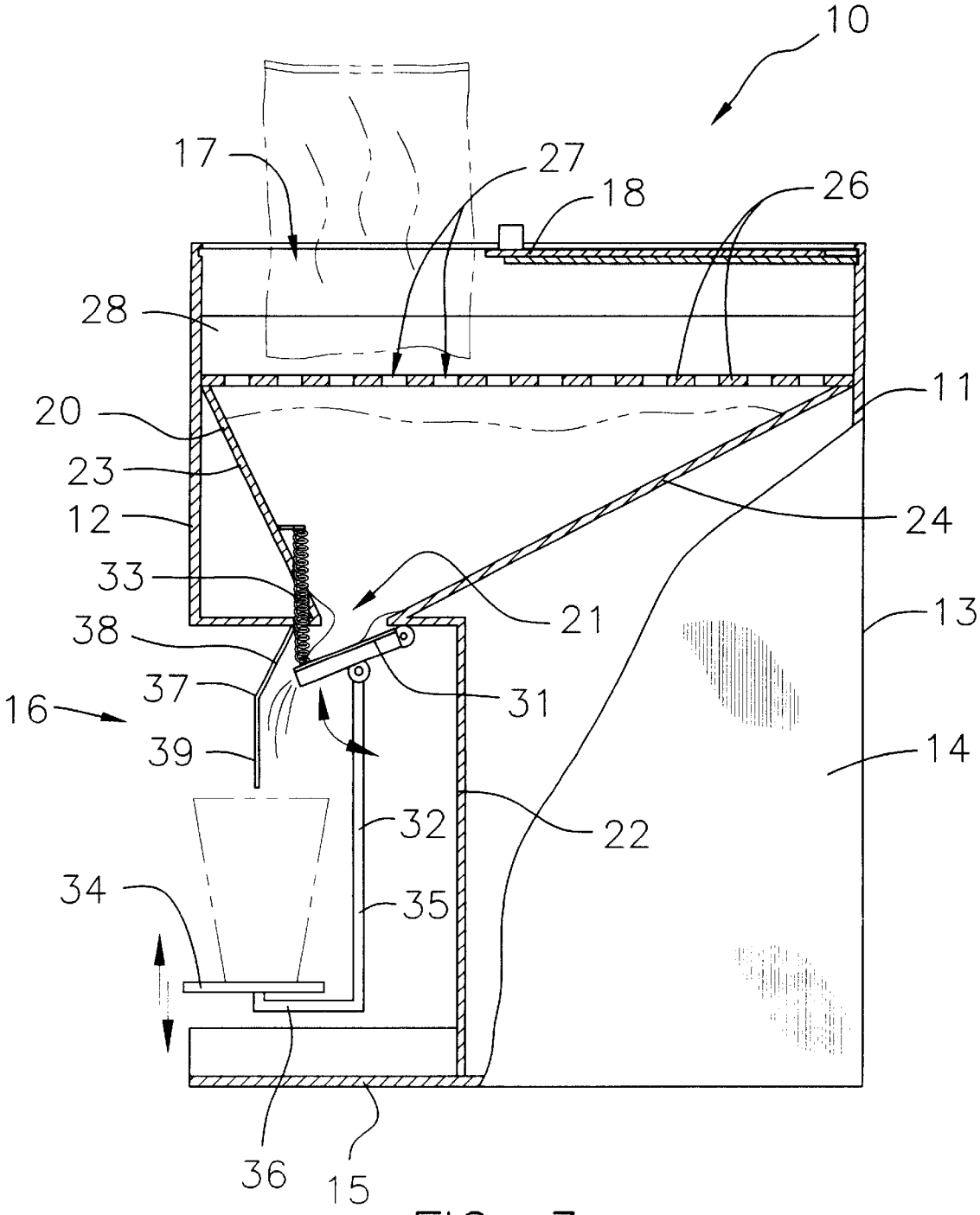
FIG. 3 is a cross-sectional view of the present invention.
Figure 4:
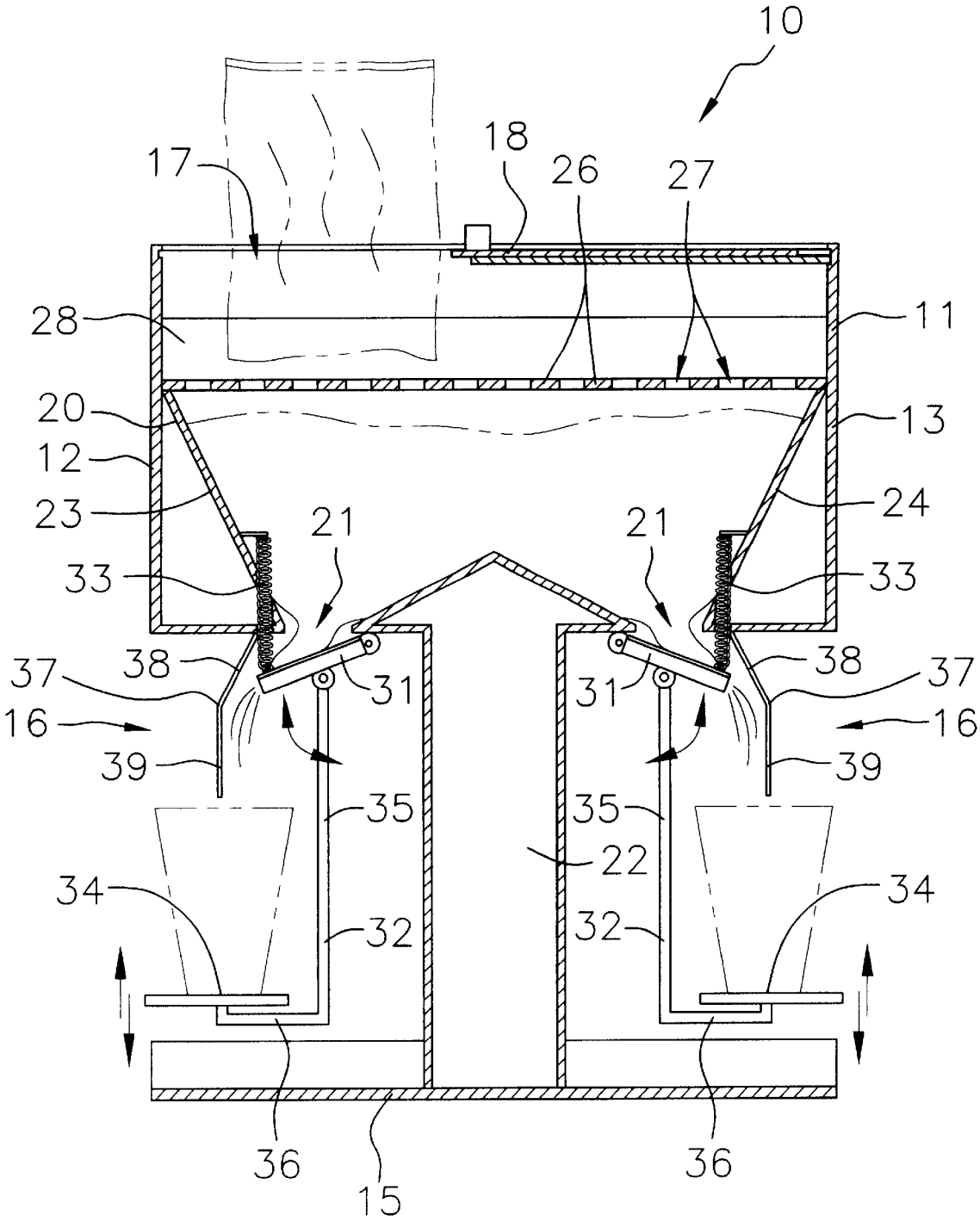
FIG. 4 is a side cross-sectional view of a second embodiment of the present invention.
Figure 5:
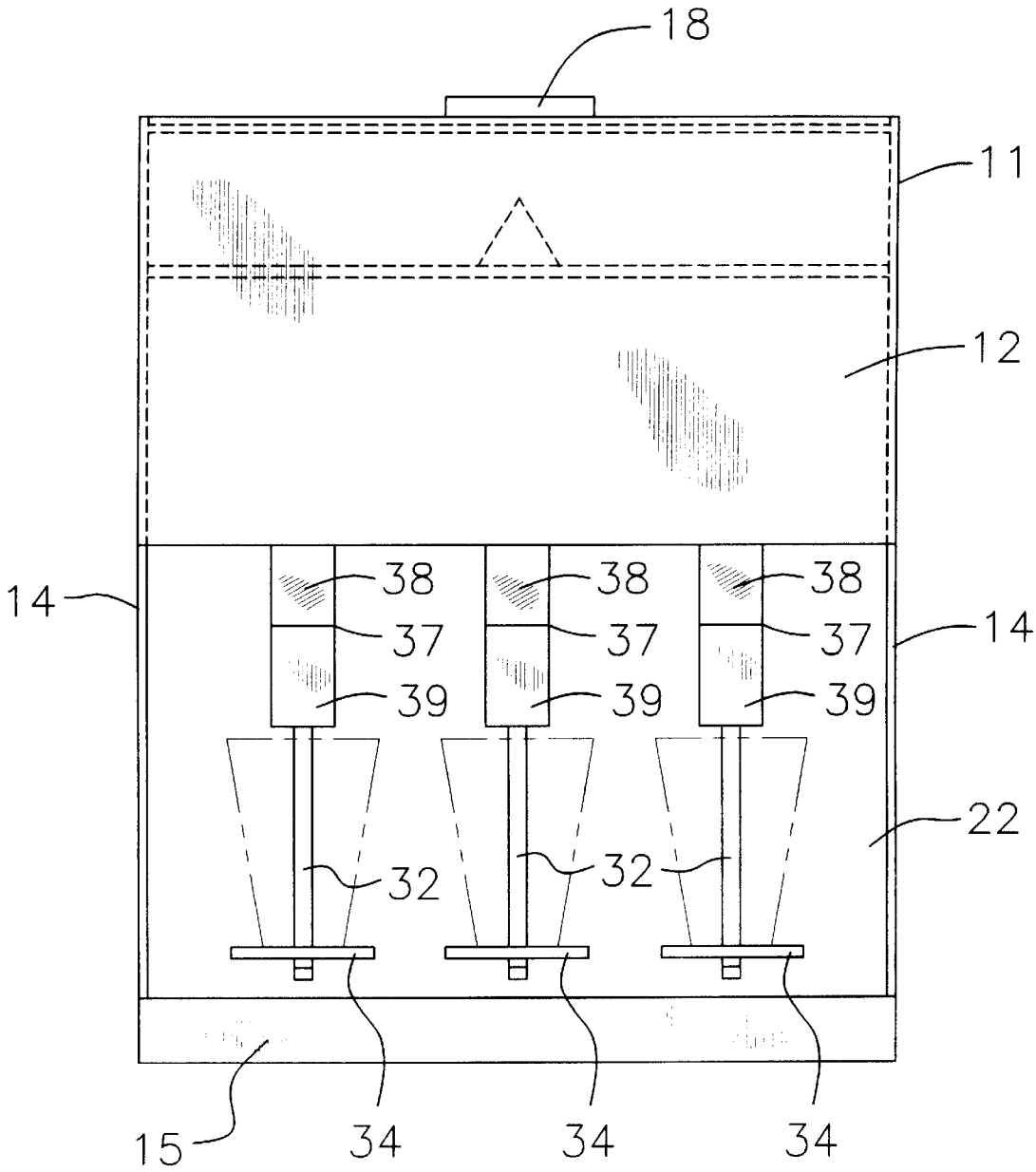
FIG. 5 is a front elevational view of a third embodiment of the present invention.

With reference now to the drawings, and in particular to FIGS. 1 through 5 thereof, a new sugar dispensing apparatus embodying the principles and concepts of the present invention and generally designated by the reference numeral 10 will be described.

As best illustrated in FIGS. 1 through 5, the sugar dispensing apparatus 10 generally comprises a housing assembly including a housing 11 having front, back, side, bottom, and top walls 12–15, and an opening 17 in the top wall, and also including a lid 18 being removably disposed over the opening 17 in the top wall of the housing 11. The housing 11 has an open lower portion 16. The housing 11 further includes tracks 19 being conventionally disposed in the walls near the opening 17 in the top wall with the lid 18 being slidably disposed in the tracks 19 and having a handle member for sliding the lid 18.

A hopper assembly includes a hopper 20 being securely and conventionally disposed in the housing 11 and having a sugar dispensing port 21. The hopper assembly further includes a hopper support member 22 being conventionally mounted upon the bottom wall 15 the housing 11 and being conventionally attached to the hopper 20 for supporting the hopper 20 in the housing 11. The hopper 20 includes side walls 23,24 which are slanted downwardly and inwardly toward the sugar dispensing port 21. The sugar dispensing port 21 is disposed through a bottom of the hopper 20. The open lower portion of the housing 11 includes the front wall 12 having an open lower portion 16.

As alternate embodiments, the open lower portion 16 of the housing 11 also includes the back wall 13 having an open lower portion 16. The sugar dispensing port 21 includes a plurality of sugar dispensing ports 21 being accessible through the open lower portions 16 of the housing 11.

A shelf 26 is securely and conventionally mounted upon the hopper 20 in the housing 11 and has a plurality of holes 27 being spaced about and being disposed therethrough and being adapted to allow sugar to enter the hopper 20. A bag-breaking member 28 is securely and conventionally disposed upon the shelf 26 for breaking a bag containing sugar. The bag breaking member 28 includes an elongate cutting member 29 being conventionally mounted upon the shelf 26 and generally extending a length thereof. The elongate member 29 has a longitudinal cutting edge 30 extending along a top of the elongate cutting member 29 for conveniently opening a bag of sugar to be dispensed upon the shelf 26. The elongate cutting member 29 has a triangular lateral cross-section with a top vertex being the longitudinal cutting edge 30.

A means for dispensing sugar from the hopper 20 through the sugar dispensing ports 16 includes one or more cover members 31 being hingedly and conventionally disposed over the one or more sugar dispensing ports 16, and also includes one or more levers 32 being hingedly and conventionally attached to the one or more cover members and being extended into the one or more open lower portions 16 of the housing 11; and further includes one or more biased elements 33 being conventionally attached to the one or more cover members 31 for biasing the one or more cover members 31 into closed positions over the one or more sugar dispensing ports; and also includes one or more platform 34 being conventionally attached to the one or more levers 32 for supporting a beverage container. The one ore more cover members 31 have ends which are hingedly and conventionally attached to the hopper assembly. The one or more levers 32 has a shaft portion 35 having a first end which is hingedly and conventionally attached to an outer side of the one or more cover members 31, and also has a second end portion 36 which is angled relative to the shaft portion 35 and which is disposed above and generally parallel to the bottom wall 15 of the housing 11. The one or more platforms 34 is generally a plate being securely and conventionally mounted upon the second end portion 36 of the one or more levers 32 and being adapted to support a beverage container and which opens the one or more cover members 31 to dispense sugar into the beverage container from the hopper 20. The one or more biased elements 33 is a spring member having a first end being attached to the hopper assembly and having a second end being attached to an inner side of the one or more cover members 31. The means for dispensing sugar from the hopper 20 includes one or more sugar dispensing guides 37 conventionally depending from the housing 11 in the one or more lower portions 16 to guide sugar being dispensed from the one or more sugar dispensing ports 21 into the beverage container. The one or more sugar dispensing guides 37 is disposed forward of the one or more sugar dispensing ports 21. The one or more sugar dispensing guides 37 is generally a plate member having an upper portion 38 and a lower portion 39 which is angled relative to the upper portion to facilitate directing the sugar from the hopper into the beverage container.

In use, the user fills the hopper 20 with sugar by using the bag breaking member 28 to open the bag of sugar onto the shelf 26 with the sugar filtering into the hopper 20 through the holes 27 in the shelf 26. The user then places a beverage container upon the one or more platforms 34 which urges the one or more cover members 31 open to dispense sugar from the hopper 20 into the beverage container. To stop the flow of sugar, the user simply removes the beverage container from the one or more platforms 34.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the sugar dispensing apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sugar dispensing apparatus comprising:

a housing assembly including a housing having front, back, side, bottom, and top walls, and an opening in said top wall, and also including a lid being removably disposed over said opening in said top wall of said housing;

a hopper assembly including a hopper being securely disposed in said housing and having at least one sugar dispensing port;

a shelf being securely mounted upon said hopper in said housing and having a plurality of holes being spaced about and being disposed therethrough and being adapted to allow sugar to enter said hopper;

a bag-breaking member being securely disposed upon said shelf for breaking a bag containing sugar; and a means for dispensing sugar from said hopper through said at least one sugar dispensing port.

2. A sugar dispensing apparatus as described in claim 1, wherein said housing has at least one open lower portion.

3. A sugar dispensing apparatus as described in claim 2, wherein said housing further includes tracks being disposed in said walls near said opening in said top wall, said lid being slidably disposed in said tracks and having a handle member for sliding said lid.

4. A sugar dispensing apparatus as described in claim 3, wherein said hopper assembly further includes a hopper support member being mounted upon the bottom wall in the housing and being attached to the hopper for supporting the hopper in the housing.

5. A sugar dispensing apparatus as described in claim 4, wherein said hopper includes side walls which are slanted downwardly and inwardly toward said at least one sugar dispensing port, said hopper being supported upon said at least.

6. A sugar dispensing apparatus as described in claim 5, wherein said at least one sugar dispensing port is disposed through a bottom of said hopper.

7. A sugar dispensing apparatus as described in claim 2, wherein said means for dispensing sugar from said hopper includes at least one cover member being hingedly disposed over said at least one sugar dispensing port, and also includes at least one lever being hingedly attached to said at least one cover member and being extended into said at least one open lower portion of said housing; and further includes at least one biased element being attached to said at least one cover member for biasing said at least one cover member into a closed position over said at least one sugar dispensing port; and also includes at least one platform being attached to said at least one lever for supporting a beverage container.

8. A sugar dispensing apparatus as described in claim 7, wherein said at least one cover member has an end which is hingedly attached to said hopper assembly.

9. A sugar dispensing apparatus as described in claim 8, wherein said at least one lever has a shaft portion having a first end which is hingedly attached to an outer side of said at least one cover member, and also has a second end portion which is angled relative to said shaft portion and which is disposed above and generally parallel to said bottom wall of said housing.

10. A sugar dispensing apparatus as described in claim 9, wherein said at least one platform is generally a plate being securely mounted upon said second end portion of said at least one lever and being adapted to support a beverage container which opens said at least one cover member to dispense sugar into the beverage container from said hopper.

11. A sugar dispensing apparatus as described in claim 10, wherein said at least one biased element is a spring member having a first end being attached to said hopper assembly and having a second end being attached to an inner side of said at least one cover member.

12. A sugar dispensing apparatus as described in claim 7, wherein said at least one open lower portion of said housing includes said front wall having an open lower portion.

13. A sugar dispensing apparatus as described in claim 12, wherein said at least one open lower portion of said housing also includes said back wall having an open lower portion.

14. A sugar dispensing apparatus as described in claim 13, wherein said at least one sugar dispensing port includes a plurality of sugar dispensing ports being accessible through said open lower portions of said housing.

15. A sugar dispensing apparatus as described in claim 7, wherein said means for dispensing sugar from said hopper includes at least one sugar dispensing guide depending from said housing into said at least one open lower portion to guide sugar being dispensed from said at least one sugar dispensing port into the beverage container, said at least one sugar dispensing guide being disposed forward of said at least one sugar dispensing port.

16. A sugar dispensing apparatus as described in claim 15, wherein said at least one sugar dispensing guide is generally a plate member having an upper portion and a lower portion which is angled relative to said upper portion to facilitate directing the sugar from said hopper into the beverage container.

17. A sugar dispensing apparatus as described in claim 1, wherein said bag breaking member includes an elongate cutting member being mounted upon said shelf and generally extending a length thereof, said elongate member having a longitudinal cutting edge extending along a top of said elongate cutting member for conveniently opening a bag of sugar to be dispensed upon said shelf.

18. A sugar dispensing apparatus as described in claim 17, wherein said elongate cutting member has a triangular lateral cross-section with a top vertex being said longitudinal cutting edge.

* * * * *